US008109741B2

(12) United States Patent
Huang

(10) Patent No.: US 8,109,741 B2
(45) Date of Patent: Feb. 7, 2012

(54) PUMP

(76) Inventor: Shou-Hsiung Huang, Taipei Hsien (TW)

( * ) Notice: Subject to any disclaimer, the term of this patent is extended or adjusted under 35 U.S.C. 154(b) by 968 days.

(21) Appl. No.: 12/102,094

(22) Filed: Apr. 14, 2008

(65) Prior Publication Data

US 2009/0041592 A1 Feb. 12, 2009

(30) Foreign Application Priority Data

Aug. 6, 2007 (TW) ..... 96212874 U

(51) Int. Cl.
*F04B 35/04* (2006.01)

(52) U.S. Cl. ..... 417/423.1; 417/423.14; 417/423.11; 417/368; 137/554

(58) Field of Classification Search ..... 417/423.1, 417/423.14, 44.2, 44.9, 423.11, 368, 369; 137/554; 200/81.9 M
See application file for complete search history.

(56) References Cited

U.S. PATENT DOCUMENTS 2,364,168 A * 12/1944 Shallenberg ..... 415/224
4,879,439 A * 11/1989 Banus Garcia ..... 200/81.9 M
5,259,733 A * 11/1993 Gigliotti et al. ..... 417/38
5,927,950 A * 7/1999 Juvenal ..... 417/38
5,961,292 A * 10/1999 Shui et al. ..... 417/44.1
6,296,459 B1 * 10/2001 Saputo et al. ..... 417/423.14
6,607,360 B2 * 8/2003 Fong ..... 417/44.9
7,710,282 B1 * 5/2010 Young ..... 340/606
2003/0003002 A1 * 1/2003 Miyazaki et al. ..... 417/423.11
2003/0037822 A1 * 2/2003 Fischer et al. ..... 137/528

* cited by examiner

*Primary Examiner* — Charles Freay
*Assistant Examiner* — Christopher Bobish
(74) *Attorney, Agent, or Firm* — Alan Kamrath; Kamrath IP Lawfirm, PA

(57) ABSTRACT

A pump has a body and a pressurizing barrel. The body has an outlet tube and a magnetic check valve mounted in the outlet tube to prevent a back-flow current from damaging an impeller mounted inside the body. When closed, the magnetic check valve actuates a magnetic switch to signal external devices. The pressurizing barrel has a tank containing liquid for compensating a pressure in the body and a casing. The casing is externally mounted on the pressurizing barrel, defines a notch for receiving a circuit board and has a detachable cap to facilitate maintenance of the circuit board. Accordingly, the pump effectively prevents impeller and motor damage due to the back-flow current. Moreover, the casing facilitates maintenance of the circuit board.

6 Claims, 6 Drawing Sheets

PUMP

BACKGROUND OF THE INVENTION

1. Field of the Invention

The present invention relates to a pump, and more particularly to a pump that effectively avoids an impeller being damaged by back-flow current while facilitating maintenance and adjustment.

2. Description of Related Art

Pumps are widely used in people's daily life for liquid transmission. A conventional pump comprises a body and a pressurizing barrel.

The body is plastic and has a chamber defined therein and an impeller mounted rotatably inside the chamber. The impeller connects to a motor or a turbine and is driven to rotate thereby. Furthermore, the body has an inlet tube and an outlet tube that are mounted securely on the body and communicate with the chamber.

The pressurizing barrel is connected with the body via a connecting pipe and has a circuit board. A pneumatic pressurizing assembly is mounted inside the pressurizing barrel to provide additional pressure to selectively raise pressure of the pump for increased load to prevent motor burn out or damage caused by overloading when pressure in the outlet pipe is changed. The circuit board controls operation of the pressurizing barrel.

To avoid liquid in the chamber flowing back into the inlet tube when the impeller stops operation, the pump has a one-way valve mounted in the inlet tube of the body. However, the conventional pump as described does not prevent liquid remaining in the outlet tube from returning to the impeller, and this back-flow current may damage the impeller when the impeller stops.

Otherwise, the circuit board is embedded in the pressurizing barrel and causes inconvenience for maintenance, and the pneumatic pressurizing assembly is awkward to adjust.

The present invention therefore provides a pump to obviate or mitigate the aforementioned problems.

SUMMARY OF THE INVENTION

The main objective of the present invention is to provide a pump that avoids impeller damage due to back-flow current while facilitating maintenance and adjustment.

To achieve the objective, the pump in accordance with the present invention comprises a body and a pressurizing barrel.

The body has an inlet tube, an outlet tube, a chamber, an impeller and a magnetic check valve. The chamber is defined in the body. The impeller is mounted rotatably in the chamber. The magnetic check valve is mounted in the outlet tube to prevent liquid from flowing back into the chamber and damaging the impeller. When closed, the magnetic check valve actuates a magnetic switch to signal external devices.

The pressurizing barrel has a tank containing liquid, a casing and a spring-motivated pressurizing assembly.

The casing is externally mounted on the pressurizing barrel and defines a notch for receiving a circuit board that controls an operation of the pressurizing barrel. The casing has an opening and a cap detachably mounted on the opening. When the circuit board requires replacement or maintenance, the cap may be removed, and repairs to the circuit board are easily performed.

The spring-motivated pressurizing assembly is mounted inside the pressurizing barrel and comprises a liquid compressor, a spring and an adjustment bracket. The liquid compressor selectively pressurizes liquid stored in the tank by changing a position in the tank. The spring has a proximal end and a distal end. The distal end of the spring abuts the liquid compressor and, thereby, provides consistent pressure to the liquid compressor. The adjustment bracket is controllably mounted movably in the tank and abuts against the proximal end of the spring. By adjusting a position of the adjustment bracket, a resilient force of the spring applied to the liquid compressor may change accordingly.

Therefore, the pump effectively prevents impeller and motor damage due to the back-flow current. Moreover, the casing facilitates maintenance of the circuit board, and the spring-motivated pressurizing assembly facilitates the adjustment of pressure inside the tank.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
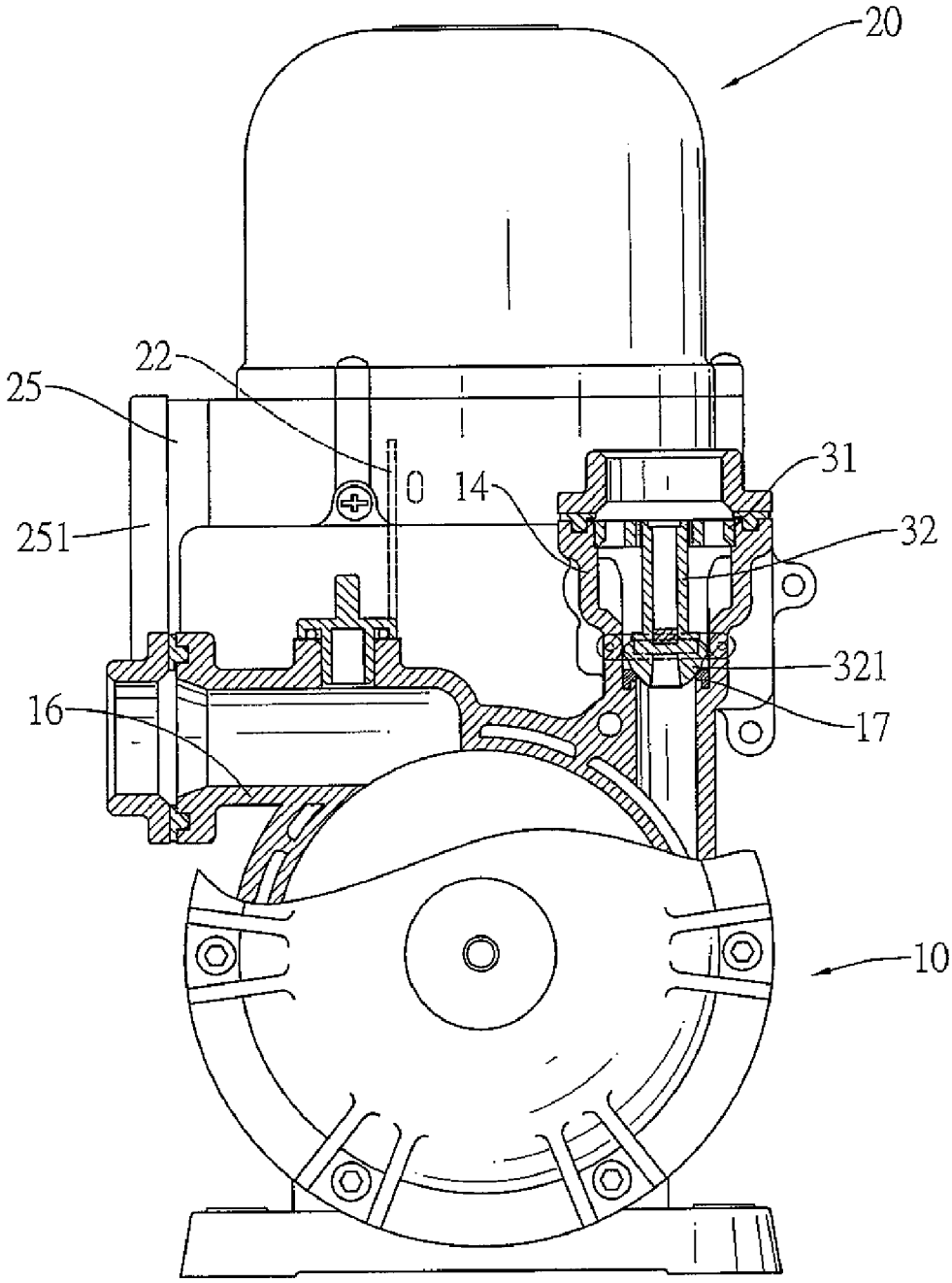
FIG. 1 is an end view in partial section of a pump in accordance with the present invention.
Figure 2:
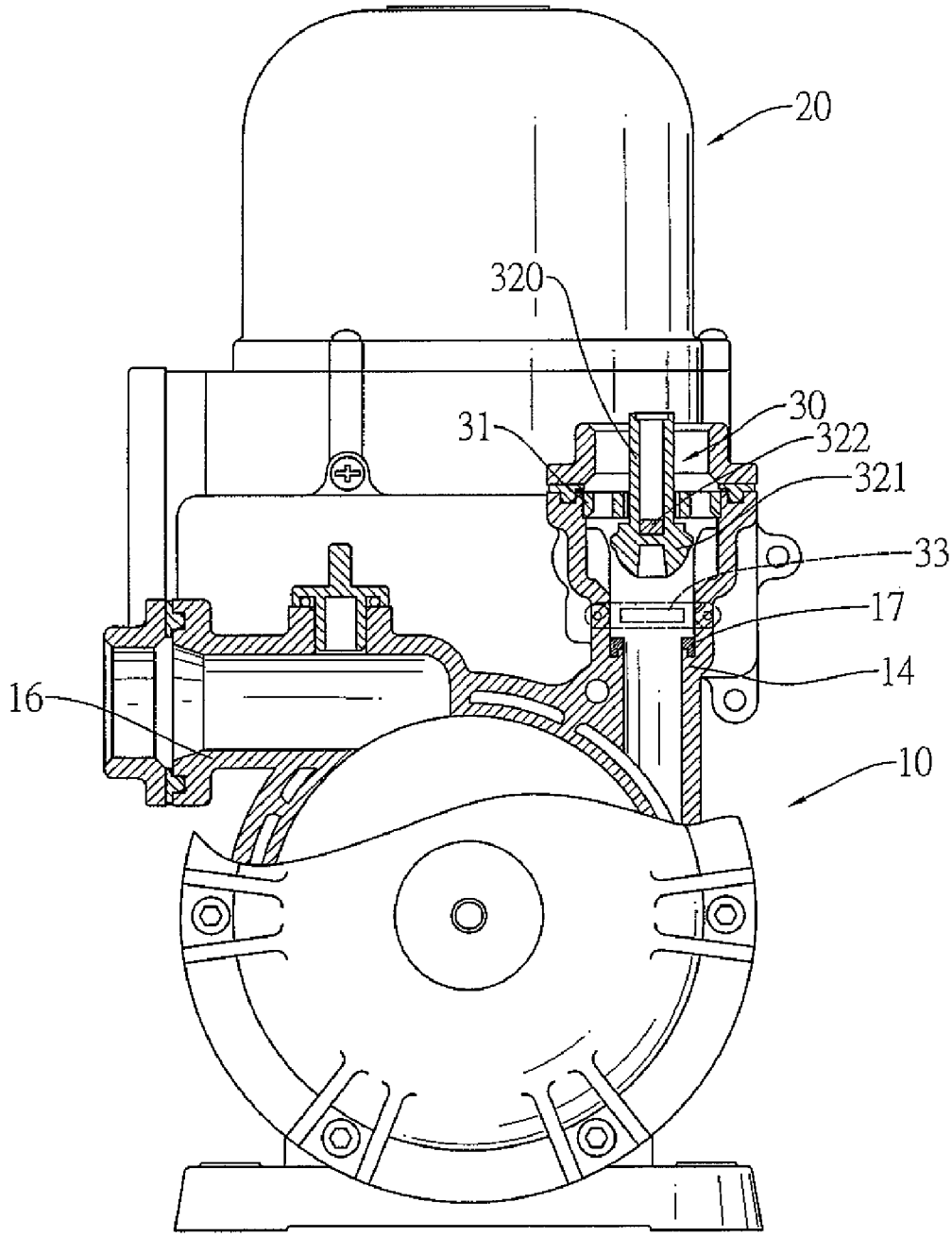
FIG. 2 is an operational end view in partial section of the pump in FIG. 1.
Figure 5:
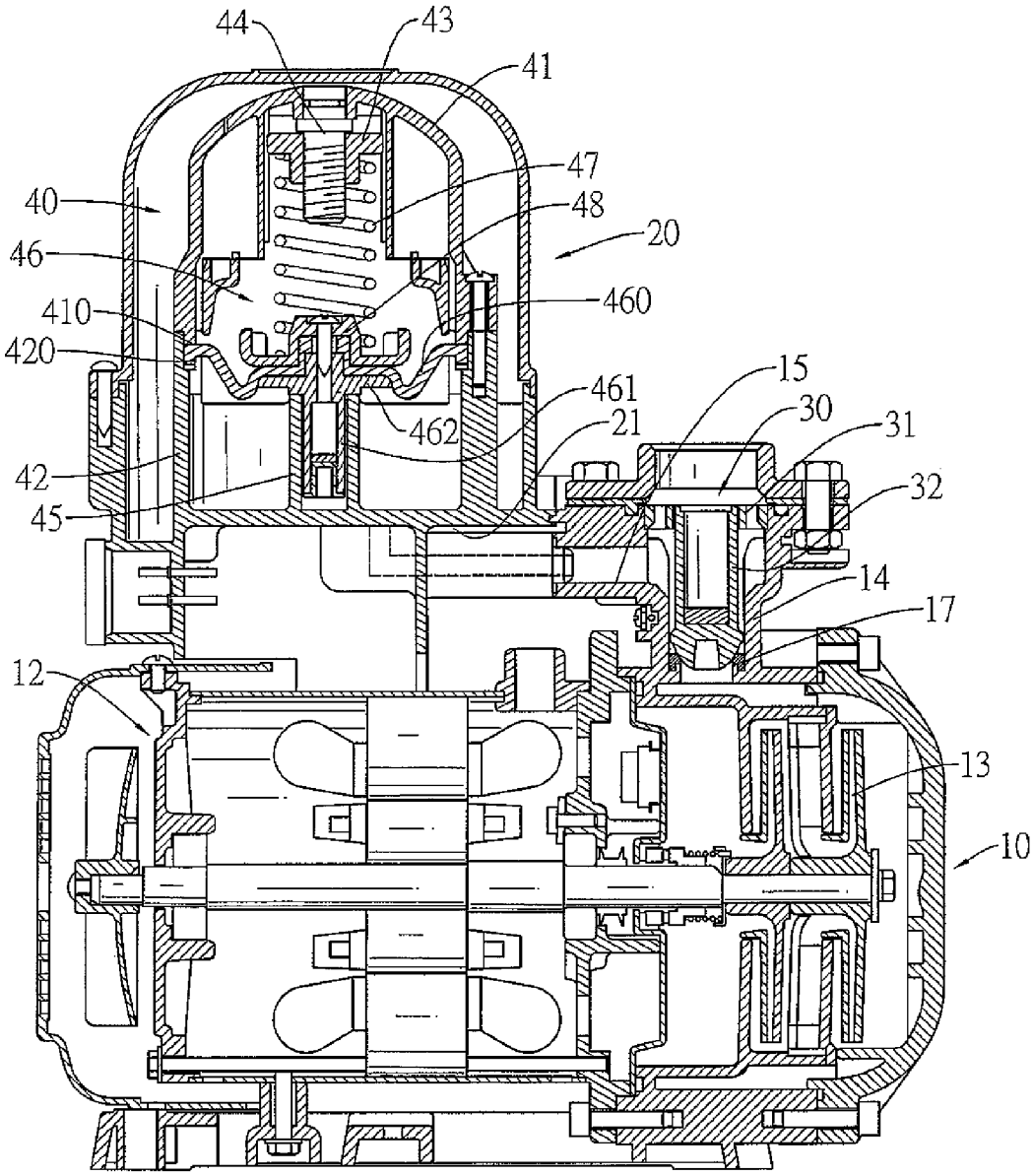
FIG. 5 is a side view in partial section of the pump in FIG. 1.

With reference to FIGS. 1, 2 and 5, the pump in accordance with the present invention comprises a body (10) and a pressurizing barrel (20). The body (10) is plastic and has a chamber, a connecting pipe (15), an inlet tube (16), an outlet tube (14), an impeller (13), an optional one-way valve and a magnetic check valve (30). The chamber is defined inside the body (10). The inlet tube (16), the connecting pipe (15) and the outlet tube (14) are mounted securely on the body (10) and communicate with the chamber. The outlet tube (14) has an inner end, an inner surface and a rubber gasket (17) mounted securely in the inner surface at the inner end. The impeller (13) is mounted rotatably inside the chamber and is connected to and driven by a motor (12). The one-way valve is mounted in the inlet tube (16) of the body (10).

Figure 3:
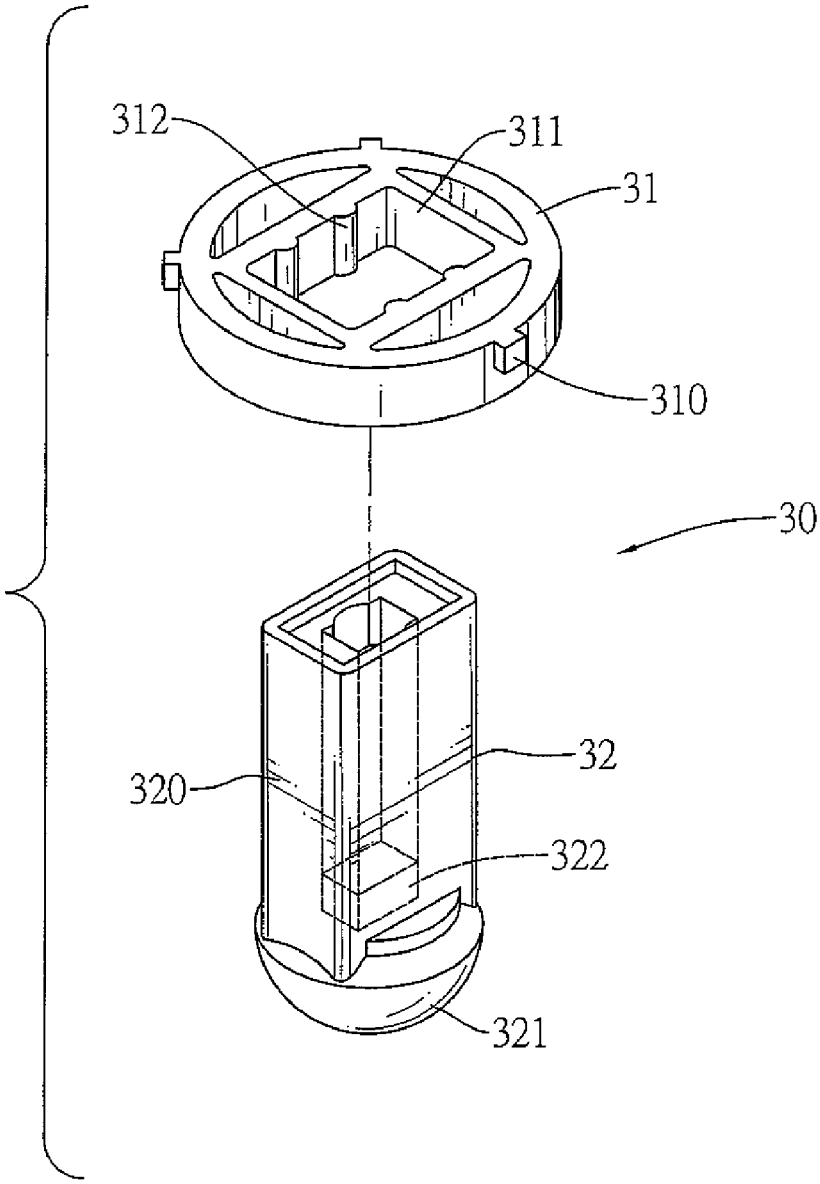
FIG. 3 is an exploded perspective view of the magnetic check valve of the pump in FIG. 1.

With further reference to FIG. 3, the magnetic check valve (30) is mounted in the outlet tube (14) and comprises a guide bracket (31), a spindle (32) and a magnetic switch (33). The guide bracket (31) corresponds to and is mounted securely in the outlet tube (14) and has a center, multiple bosses (310), multiple through holes and a mounting hole (311). The bosses (310) protrude from around the guide bracket (31) and engage the inner surface of the outlet tube (14) to mount the guide bracket (31) securely in the outlet tube (14). The through holes are formed through the guide bracket (31) allowing liquid to pass therethrough. The mounting hole (311) is defined through the center of the guide bracket (31), may be quadrangular and may have an inner surface and multiple ribs (312) formed on and protruding from the inner surface of the mounting hole (311). The spindle (32) has a rod (320) and a staffing nut (321). The rod (320) of the spindle (32) may be quadrangular in cross section, corresponds to and is mounted slidably in the mounting hole (311) of the guide bracket (31)

and has a magnet recess. A magnet (322) is mounted in the magnet recess, and two side surfaces of the magnet (322) may contact the ribs (312) of the mounting hole (311) of the guide bracket (31) to ensure the rod (320) moves through the guide bracket (31) smoothly by reducing friction therebetween. The stuffing nut (321) is formed on the rod (320) selectively closing the outlet tube (14) and may have a domical surface selectively abutting the rubber gasket (17). When the stuffing nut (321) is disposed in an original position relative to the guide bracket (31) (as shown in FIG. 1), the domical surface of the stuffing nut (321) abuts the gasket (17) and blocks a back-flow current in the outlet tube (14) to prevent the impeller (13) from being damaged. The magnetic switch (33) is mounted securely in the outlet tube (14) adjacent to the guide bracket (31) of the magnetic check valve (30) and is actuated by the magnet (322) when the stuffing nut (321) is in the original position to actuate an external mechanism or device corresponding to the pump. When the impeller (13) is in operation, liquid pressure is raised forcing the stuffing nut (321) to open and liquid to pass through the guide bracket (31). However, when the impeller 13 is not operating, liquid traveling towards the impeller (13) pushes the stuffing nut (321) towards the impeller (13), thereby preventing liquid flow.

Figure 4:
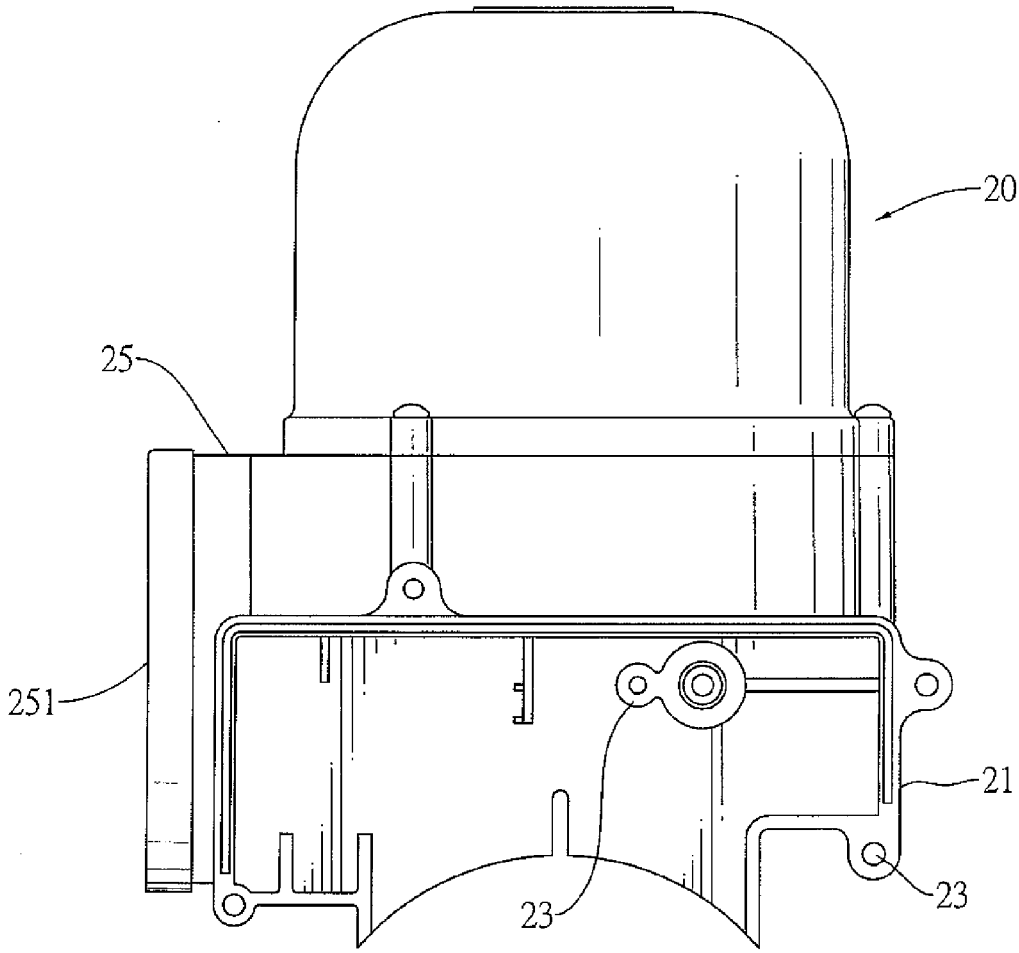
FIG. 4 is an end view of the pump in FIG. 1.
Figure 6:
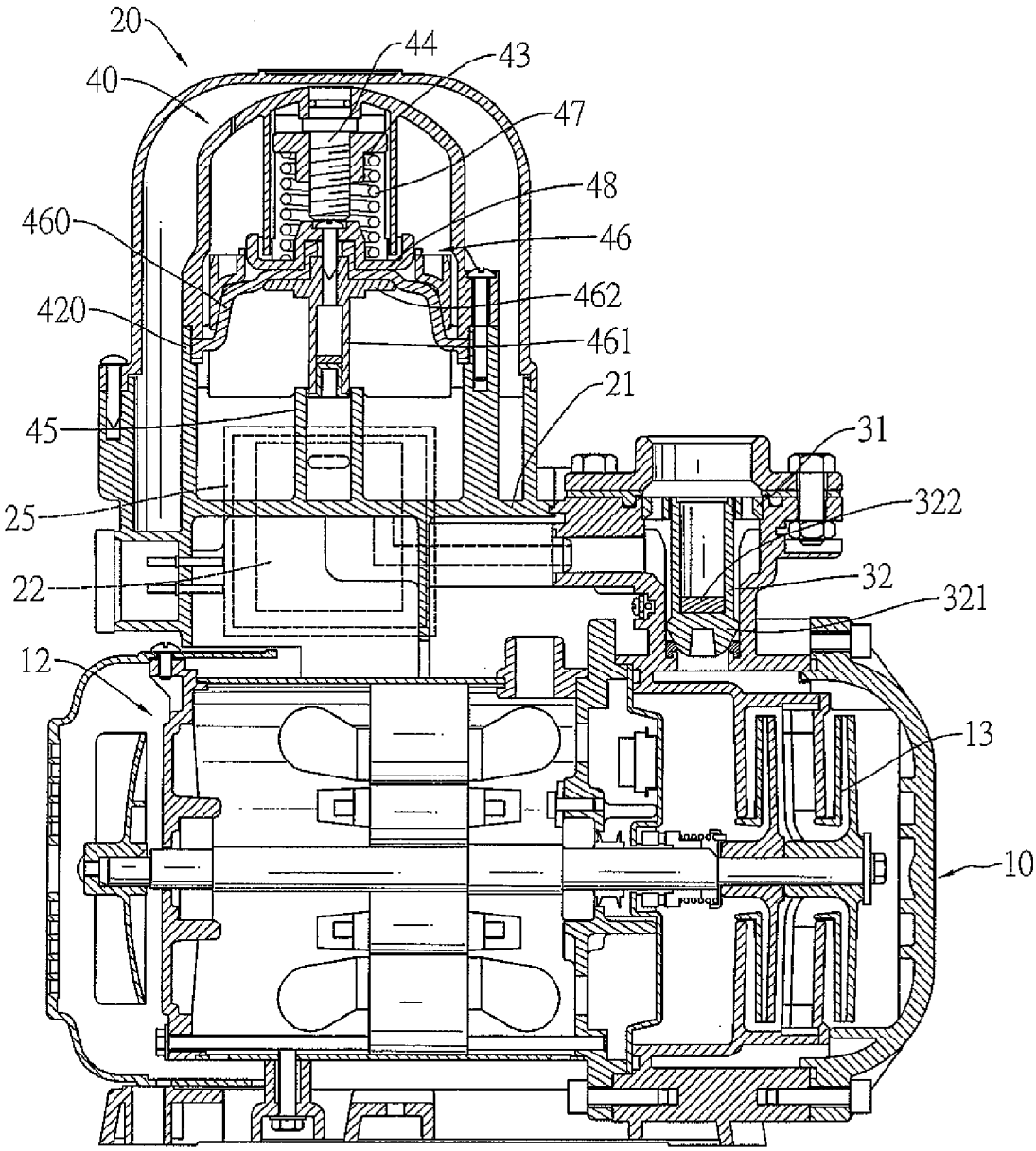
FIG. 6 is an operational side view in partial section of the pump in FIG. 1.

With further reference to FIGS. 4 and 6, the pressurizing barrel (20) communicates with the body (10) through the connecting pipe (15) and has a connecting bracket (21), a casing (25), a circuit board (22), a tank (40) and a spring-motivated pressurizing assembly. The connecting bracket (21) has multiple threaded holes (23) to allow the connecting bracket (21) to be securely mounted on the body (10). The casing (25) is mounted on the pressurizing barrel (20) and has a notch, an opening and a cap (251). The notch is defined in the casing (25). The cap (251) is removably mounted on the opening. The circuit board (22) controls operation of the pressurizing barrel (20) and is detachably mounted inside the notch of the casing (25). The tank (40) is formed inside the pressurizing barrel (20) for storing liquid and communicates with the chamber of the body (10) through the connecting pipe (15) and comprises a base (42) and a cover (41). The base (42) has an upper opening, an upper edge (420) formed around the upper opening, a space for storing liquid that selectively flows through the connecting pipe (15) to compensate pressure in the chamber, and a central column (45) protruding from a bottom of the base (42). The cover (41) is mounted on the upper opening of the base (42) and has a lower edge (410) and an adjustment bolt (44). The lower edge (410) of the cover (41) engages the upper edge (420) of the base (42). The adjustment bolt (44) is threaded and is mounted centrally through the cover (41) and has a top end extending through the cover (41) for manual rotation and adjustment.

The spring-motivated pressurizing assembly is mounted inside tank (40) of the pressurizing barrel (20) and comprises a liquid compressor (46), an adjustment bracket (43) and a spring (47). The liquid compressor (46) has a central post (461) and a flexible diaphragm (460). The central post (461) is slidably mounted in the central column (45) of the base (42) and has an upper end, a lower disk (462) integrally connected with the upper end of the central post (461) and an upper disk (48) mounted securely on the upper end. The flexible diaphragm (460) has a center secured to the upper end of the central post (461), may be securely clamped between the upper disk (48) and the lower disk (462) on the upper end of the central post (461), has a rim securely attached hermetically between the lower edge (410) of the cover (41) and the upper edge (420) of the base (42) and selectively pressurizes liquid stored in the tank (40) by changing a position of the central post (461) in the tank (40). The adjustment bracket (43) is mounted rotatably on the adjustment bolt (44) slidably in the tank (40) so that when the adjustment bolt (44) is rotated, the adjustment bracket (43) moves towards or away from the central post (461). The spring (47) is mounted between the cover (41) and the liquid compressor (46) and has a proximal end abutting the adjustment bracket (43) and a distal end abutting the liquid thereby providing a consistent pressure to the liquid compressor (46).

By adjusting a position of the adjustment bracket (43), a resilient force of the spring (47) applied to the liquid compressor (46) may change accordingly. Thus, additional pressure to selectively raise pressure of the pump for increased load to prevent motor burn out or damage caused by overloading when pressure in the outlet tube (14) is changed.

Therefore, the pump in accordance with the present invention effectively prevents the impeller (13) from being damaged due to the back-flow current. Moreover, when the circuit board (22) fails, is broken, or requires servicing, the cap (251) can be detached from the casing (25) for easy maintenance or replacement of the circuit board (22).

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A pump comprising a body having a chamber defined inside the body;

an inlet tube and a connecting pipe mounted securely on the body and communicating with the chamber;

an outlet tube mounted securely on the body and communicating with the chamber;

an impeller mounted rotatably inside the chamber and connected to and driven by a motor; and a magnetic check valve mounted in the outlet tube and comprising a guide bracket corresponding to and mounted securely in the outlet tube and having a center;

multiple through holes formed through the guide bracket to allow liquid to pass therethrough; and a mounting hole defined through the center of the guide bracket and being quadrangular;

a spindle having a rod being quadrangular in cross section, corresponding to and mounted slidably in the mounting hole of the guide bracket and having a magnet recess; and a magnet mounted in the magnet recess; and a stuffing nut formed on the rod and selectively closing the outlet tube; and a magnetic switch mounted securely in the outlet tube adjacent to the guide bracket of the magnetic check valve and selectively actuated by the magnet; and a pressurizing barrel communicating with the body through the connecting pipe and having a connecting bracket mounted securely on the body;

a casing mounted on the pressurizing barrel and having a notch defined in the casing;

an opening; and a cap removably mounted on the opening; and a circuit board controlling operation of the pressurizing barrel and detachably mounted inside the notch of the casing.

2. The pump as claimed in claim 1, wherein the pressurizing barrel further has a tank formed inside the pressurizing barrel for storing liquid and communicating with the chamber of the body through the connecting pipe and comprising a base having an upper opening;

an upper edge formed around the upper opening;

a space for storing liquid selectively flowing through the connecting pipe to compensate pressure in the chamber; and a central column protruding from a bottom of the base; and a cover mounted on the upper opening of the base and having a lower edge engaging the upper edge of the base; and an adjustment bolt threaded and mounted centrally through the cover and having a top end extending through the cover for manual rotation and adjustment; and a spring-motivated pressurizing assembly mounted inside the tank of the pressurizing barrel and comprising a liquid compressor having a central post slidably mounted in the central column of the base and having an upper end; and a flexible diaphragm having a center secured with the upper end of the central post and a rim securely attached hermitically between the lower edge of the cover and the upper edge of the base and selectively pressurizing liquid stored in the tank;

an adjustment bracket mounted rotatably on the adjustment bolt and slidably in the tank, thereby moving towards or away from the central post when the adjustment bolt is rotated; and a spring mounted between the cover and the liquid compressor and having a proximal end abutting the adjustment bracket; and a distal end abutting the liquid compressor, thereby providing a consistent pressure to the liquid compressor.

3. The pump as claimed in claim 2, wherein the outlet tube further has an inner end, an inner surface and a rubber gasket mounted securely in the inner surface at the inner end; and the stuffing nut of the spindle further has a domical surface selectively abutting the rubber gasket to close the outlet tube.

4. The pump as claimed in claim 2, wherein the mounting hole of the guide bracket further has an inner surface and multiple ribs formed on and protruding from the inner surface of the mounting hole; and the rod of the spindle further has two side surfaces contacting the ribs of the mounting hole of the guide bracket, thereby ensuring the rod moves through the guide bracket smoothly.

5. The pump as claimed in claim 2, wherein the guide bracket of the magnetic check valve further has multiple bosses protruding from around the guide bracket and engaging the inner surface of the outlet tube to mount the guide bracket securely in the outlet tube.

6. The pump as claimed in claim 2, wherein the body is plastic.

* * * * *